US010678178B2

(12) United States Patent
Honma

(10) Patent No.: US 10,678,178 B2
(45) Date of Patent: Jun. 9, 2020

(54) ROLL-PAPER PRINTING APPARATUS, PRINTING CONTROL PROGRAM, AND PRINTING CONTROL METHOD

(71) Applicant: Konica Minolta Inc., Tokyo (JP)

(72) Inventor: Mikimasa Honma, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/376,241

(22) Filed: Apr. 5, 2019

(65) Prior Publication Data

US 2019/0317441 A1 Oct. 17, 2019

(30) Foreign Application Priority Data

Apr. 11, 2018 (JP) ..... 2018-075950

(51) Int. Cl.
*G03G 15/00* (2006.01)

(52) U.S. Cl.
CPC ..... *G03G 15/55* (2013.01); *G03G 15/5062* (2013.01); *G03G 15/6523* (2013.01)

(58) Field of Classification Search
CPC ..... G03G 15/5062; G03G 15/55; G03G 15/6517; G03G 15/6523
See application file for complete search history.

(56) References Cited

U.S. PATENT DOCUMENTS 2,214,593 A * 9/1940 Mustin et al. ..... B65H 23/1882 83/29
2008/0112746 A1* 5/2008 Yamamoto ..... G03G 15/6523 399/385

FOREIGN PATENT DOCUMENTS

JP 2003259064 A 9/2003
JP 2007178579 A 7/2007
JP 2016114778 A * 6/2016
JP 2016124236 A 7/2016

OTHER PUBLICATIONS

Machine translation of JP 2016-124236 A (publication date of Jul. 11, 2016) printed on Oct. 1, 2019.*
Machine translation of JP 2016-114778 A (publication date of Jun. 23, 2016) printed on Oct. 1, 2019.*

* cited by examiner

*Primary Examiner* — Sophia S Chen
(74) *Attorney, Agent, or Firm* — Cantor Colburn LLP

(57) ABSTRACT

A roll-paper printing apparatus includes a paper feeder that feeds roll paper, a printer that forms an image based on a job on the roll paper, an image scanner that scans the image formed on the roll paper, and a reeler that reels the roll paper, and the roll-paper printing apparatus includes a hardware processor that acquires the image scanned by the image scanner and detects an abnormal output in comparison between the image based on the job and the scanned image, and determines whether output of the job continues or stops, in accordance with a previously set condition, wherein, when the roll paper is cut in a passage direction of the roll paper into a plurality of lanes arrayed in a width direction of the roll paper, the hardware processor continues, in a case where the abnormal output is detected on a lane, the output of the job.

15 Claims, 15 Drawing Sheets

ROLL-PAPER PRINTING APPARATUS, PRINTING CONTROL PROGRAM, AND PRINTING CONTROL METHOD

CROSS-REFERENCE TO RELATED APPLICATION

The present invention claims priority under 35 U.S.C. § 119 to Japanese patent Application No. 2018-075950, filed on Apr. 11, 2018, is incorporated herein by reference in its entirety.

BACKGROUND

Technological Field

The present invention relates to a roll-paper printing apparatus that performs printing on roll paper, a printing control program of controlling the printing on the roll paper, and a printing control method in the roll-paper printing apparatus.

Description of the Related Art

There is a system in which an apparatus that feeds a rolled sheet (referred to as roll paper) at the pre-stage of the image forming apparatus, and an apparatus that reels the roll paper at the post-stage of the image forming apparatus are provided to perform printing on the roll paper. There is an apparatus that prints different images on a plurality of lanes of roll paper and cuts the roll paper in the passage direction of the roll paper into the plurality of lanes through a slit while reeling the roll paper, to individually reel the plurality of lanes.

There is a scanner that is connected to the post-sage of an image forming apparatus and scans an image formed on a sheet, in which comparison between the image scanned by the scanner and an image of a job enables detection of an abnormal output (waste). Examples of the abnormal output include a stain, such as a streak on an output image, a fault in density, such as undesired density, and a fault in color, such as undesired color. In a case where the abnormal output is detected, re-printing is performed or the image forming apparatus stops temporarily and, for example, adjustment or component replacement is performed.

As an exemplary technique relating to such roll-paper printing, JP 2016-124236 A discloses a printing apparatus that prints an image on a continuous sheet on the basis of image data of a job, the printing apparatus including: a controller that receives a plurality of jobs each for arraying a plurality of images each having a width narrower than the width of the continuous sheet, in the conveyance direction of the continuous sheet, and that arrays image data of the received plurality of jobs, in the width direction of the continuous sheet and disposes a zonal image extending in the conveyance direction in the region between adjacent jobs; and an imager former that prints the images of the plurality of jobs arrayed and the zonal image disposed by the controller, on the continuous sheet, in which the zonal image is disposed astride a predetermined cutting position along the conveyance direction for division of the plurality of jobs.

As an exemplary technique relating to the operation of an image forming apparatus between stopping and continuation, JP 2007-178579 A discloses an image forming apparatus including: a detector that detects whether a consumable product in the image forming apparatus is in a supply-end state; an operation display that displays operations for the image forming apparatus; a setter that sets, in a case where the consumable product requires replacing, the printing operation of the image forming apparatus between stopping and continuation through the operation display; and a switch that switches the printing operation between stopping and continuation, on the basis of the set.

JP 2003-259064 A discloses an image forming apparatus including an original conveyer that conveys an set original, an image scanner that scans an image from the original conveyed by the original conveyer, a storage that stores, per original, image data of the image scanned by the image scanner, and a printing outputter that performs printing output of the image data stored in the storage, the image forming apparatus further including: a determiner that determines whether an abnormality has occurred in the operation of the original conveyer or the printing outputter; a controller that stops the operation in which the abnormality has occurred and additionally continues the normal operation, on the basis of a determined result of the determiner; and a status storage that stores, in a case where the controller stops the operation, an operation status at the stopping, in which the controller resumes, after removal of the occurring abnormality, the stopped operation, on the basis of the operation status stored in the status storage.

Printing on roll paper does not allow stopping of paper feeding at an arbitrary timing, differently from printing on a cut sheet. That is, because a system that performs printing on roll paper, has a sheet continuous from the pre-stage to the post-stage of an image forming apparatus, stopping of paper feeding causes a trouble, such as continuously heating of the sheet due to a fixer, resulting in a possibility that a printed matter does not meet a standard as merchandise. During output on a plurality of lanes, if detection of an abnormal output in any one of the lanes causes stopping of the output, production of the other lanes stops. Thus, there is a possibility that printed matter with no trouble, output on the other lanes is wasted.

SUMMARY

The present invention has been made in consideration of the problems, and a main object of the present invention is to provide a roll-paper printing apparatus, a printing control program, and a printing control method that enable, even in a case where a lane has occurrence of an abnormal output during printing on a plurality of lanes of roll paper, continuation of output to the normal lanes.

To achieve the abovementioned object, according to an aspect of the present invention, there is provided a roll-paper printing apparatus including a paper feeder that feeds roll paper, a printer that forms an image based on a job on the roll paper, an image scanner that scans the image formed on the roll paper, and a reeler that reels the roll paper, and the roll-paper printing apparatus reflecting one aspect of the present invention comprises a hardware processor that acquires the image scanned by the image scanner from the roll paper and detects an abnormal output in comparison between the image based on the job and the scanned image, and determines whether output of the job continues or stops, in accordance with a previously set condition, wherein, in a case where the roll paper is cut in a passage direction of the roll paper into a plurality of lanes arrayed in a width direction of the roll paper, the hardware processor continues, in a case where the abnormal output is detected on a lane, the output of the job.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
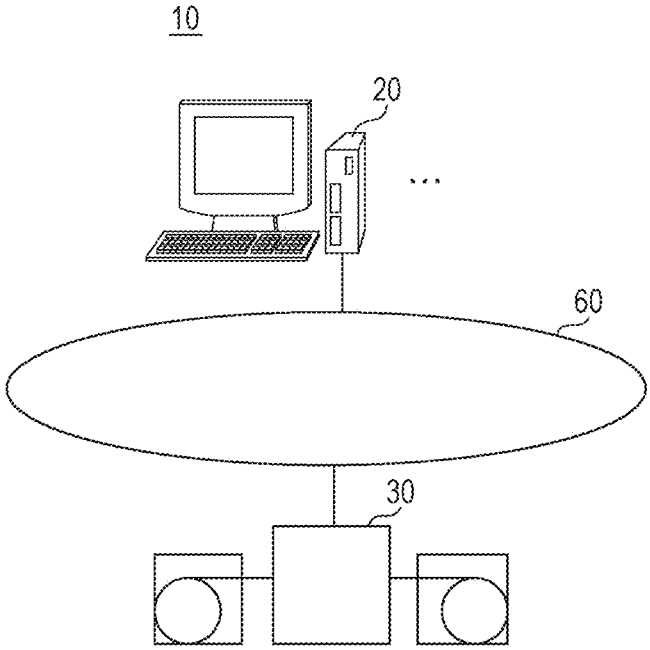
FIG. 1 is a schematic view of a configuration of a printing system according to a first embodiment of the present invention.

Hereinafter, one or more embodiments of the present invention will be described with reference to the drawings. However, the scope of the invention is not limited to the disclosed embodiments.

As described in Description of the Related art, there is a system in which an apparatus that feeds roll paper at the pre-stage of the image forming apparatus, and an apparatus that reels the roll paper at the post-stage of the image forming apparatus are provided to perform printing on the roll paper. There is an apparatus that prints different images on a plurality of lanes of roll paper and cuts the roll paper in the passage direction of the roll paper into the plurality of lanes through a slit while reeling the roll paper, to individually reel the plurality of lanes. There is a scanner that is connected to the post-sage of an image forming apparatus and scans an image formed on a sheet. A system in which such apparatuses are combined together has a sheet continuous from the pre-stage to the post-stage of the image forming apparatus. Thus, stopping of paper feeding causes a trouble, for example, at a fixer, resulting in a possibility that the printed matter does not meet a standard as merchandise. During output on a plurality of lanes, if detection of an abnormal output in any one of the lanes causes stopping of the output, production of the other lanes stops. Thus, there is a possibility that printed matter with no trouble, output on the other lanes is wasted.

Thus, according to one embodiment of the present invention, a roll-paper printing apparatus including a paper feeder that feeds roll paper, a printer that forms an image based on a job on the roll paper, an image scanner that scans the image formed on the roll paper, and a reeler that reels the roll paper, further includes: an abnormal-output detector that acquires the image scanned by the image scanner from the roll paper and detects an abnormal output in comparison between the image based on the job and the scanned image; and an operation controller that determines whether output of the job continues or stops, in accordance with a previously set condition, in which, in a case where the roll paper is cut in a passage direction of the roll paper into a plurality of lanes arrayed in a width direction of the roll paper, the operation controller controls, in a case where the abnormal output is detected on a lane, the output of the job to continue. In the case where the abnormal output is detected on the lane, generation of a predetermined image to be formed on another lane except the lane from which the abnormal output is detected causes formation of the predetermined image on the roll paper, or the printer is controlled (for example, an exposure range of an exposer is limited) so as not to form a latent image corresponding to a printing image based on an original image, to be disposed on the lane from which the abnormal output is detected. On the basis of a predetermined condition, a determination is made as to whether the output of the job continues or stops.

In this manner, continuation of the output in accordance with a predetermined condition in case of occurrence of an abnormal output on a lane enables proper use of the printed matter with no trouble, output on the other lanes. Stopping of the output to a lane having occurrence of an abnormal output enables inhibition of toner from being wastefully consumed. Prompting a user to set a predetermined condition enables acquisition of a desired output result.

First Embodiment

Figure 2:
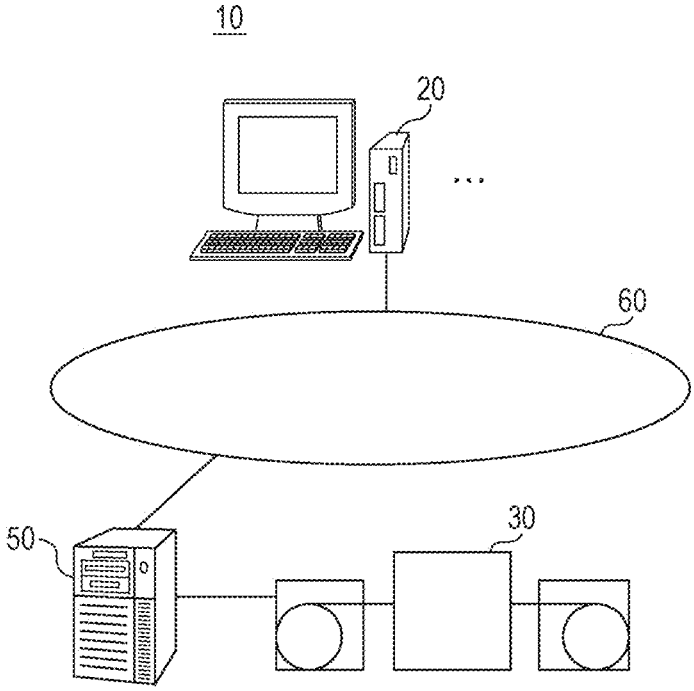
FIG. 2 is a schematic view of another configuration of the printing system according to the first embodiment of the present invention.
Figure 3A:
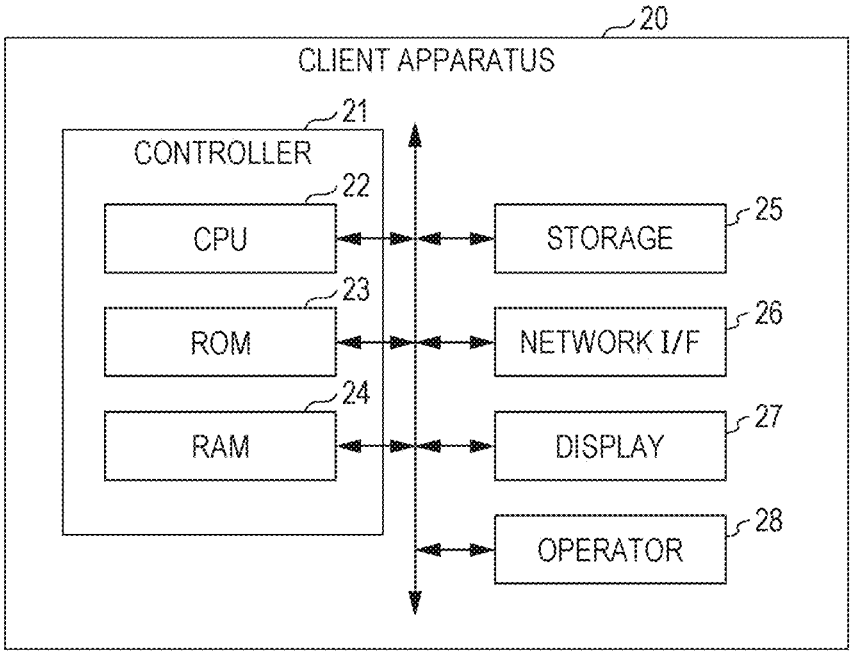
FIG. 3A and FIG. 3B are block diagrams of the configuration of a client apparatus according to the first embodiment of the present invention.
Figure 3B:
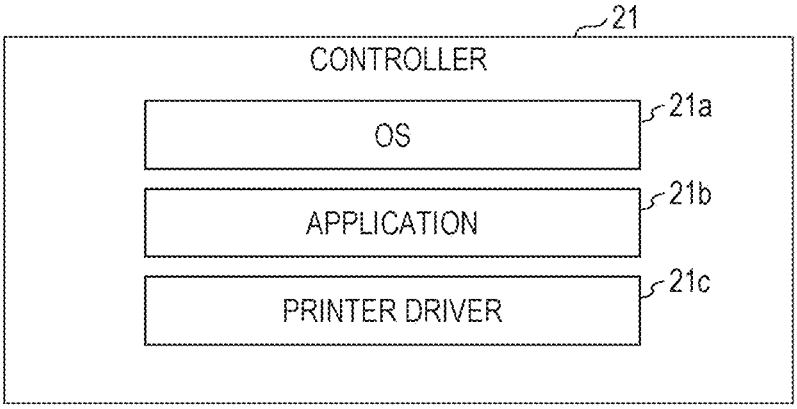
Figure 4:
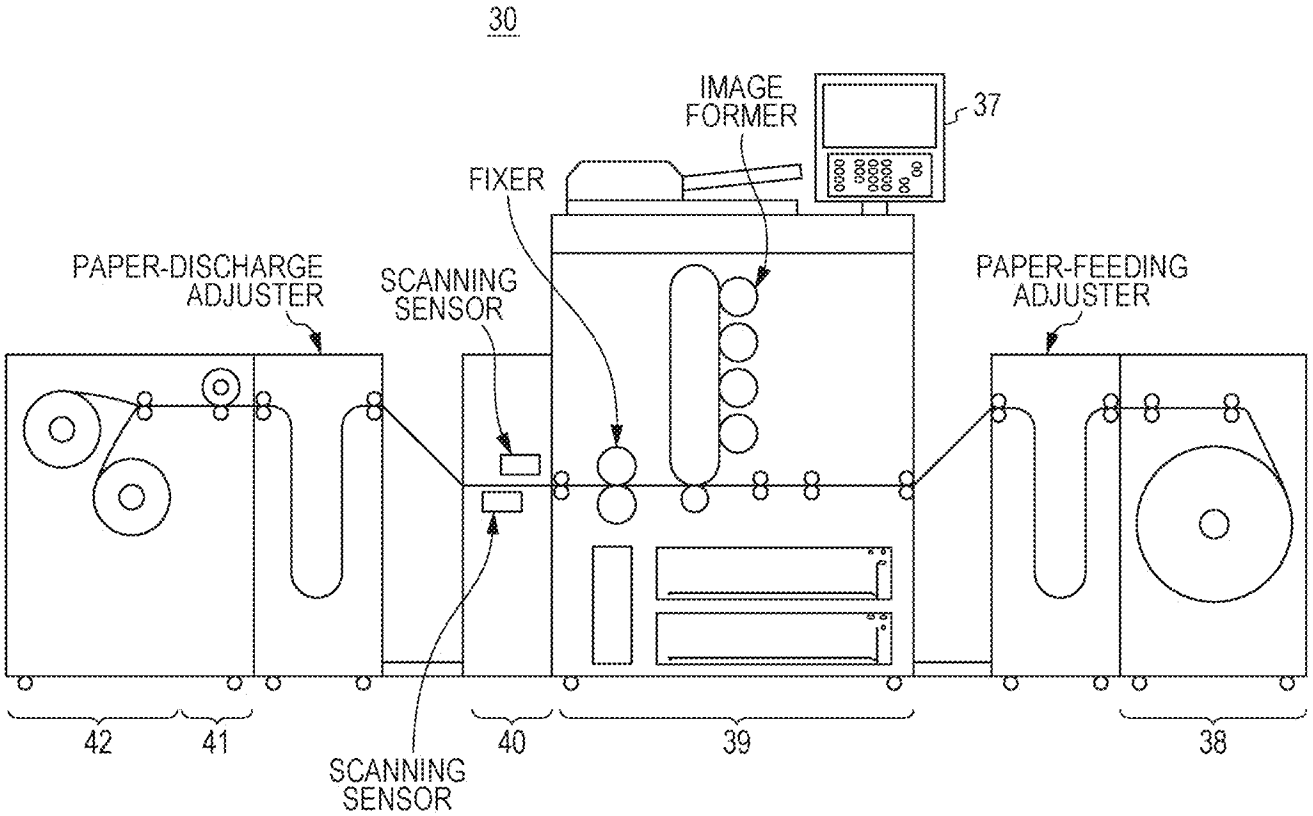
FIG. 4 is a schematic view of the configuration of a roll-paper printing apparatus according to the first embodiment of the present invention.
Figure 5:
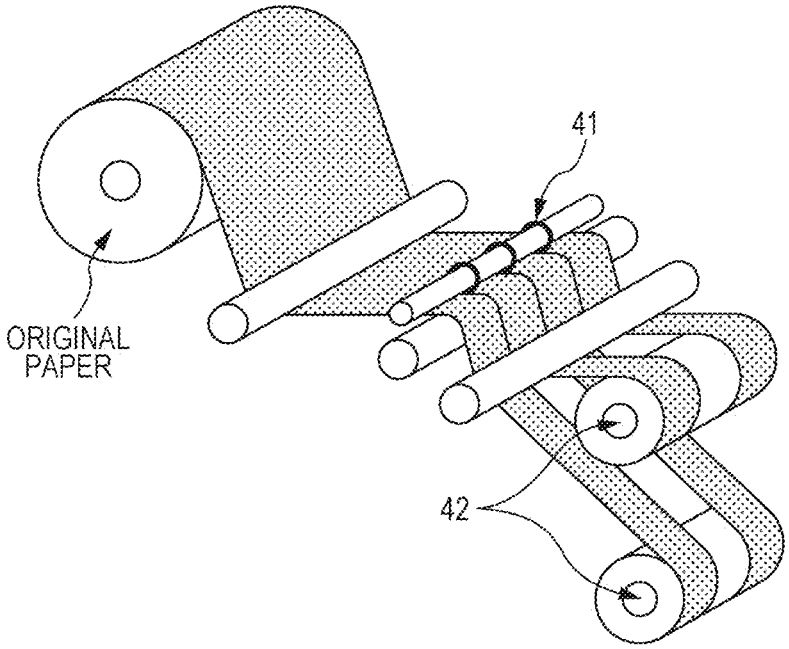
FIG. 5 is a schematic view for describing the configuration of a cutting mechanism of the roll-paper printing apparatus according to the first embodiment of the present invention.
Figure 6A:
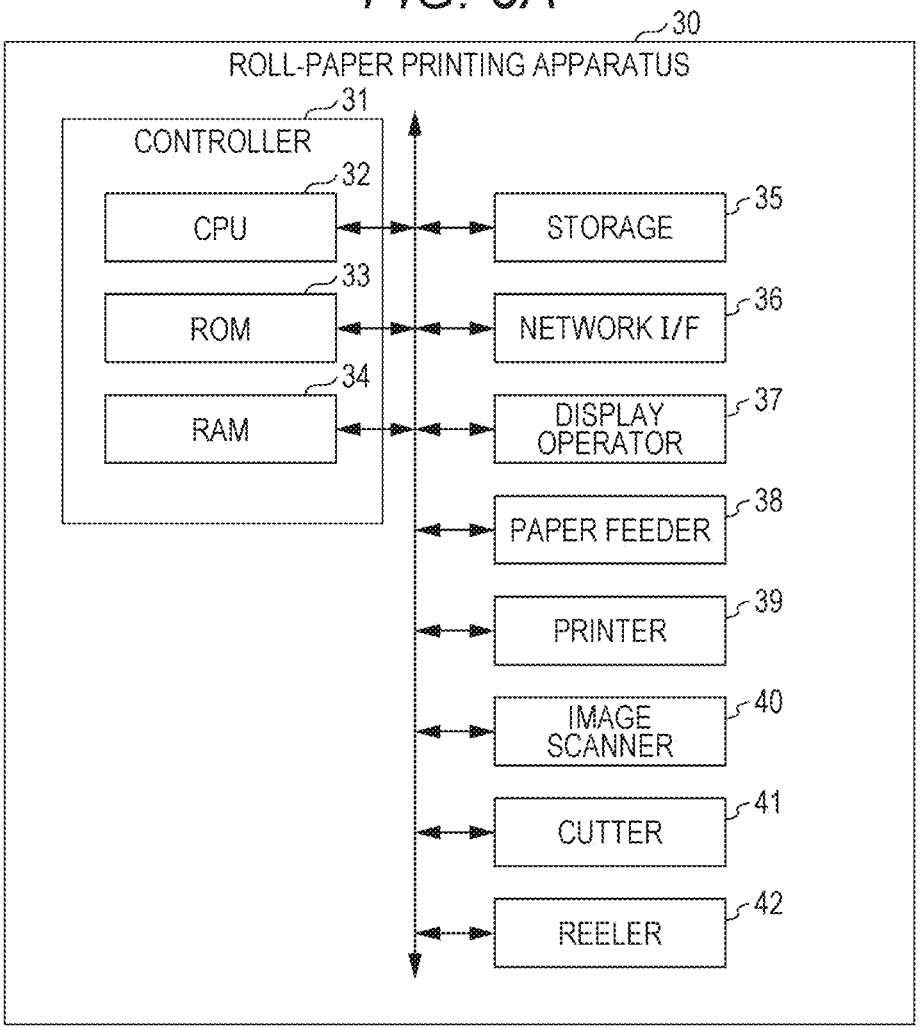
FIG. 6A and FIG. 6B are block diagrams of the configuration of the roll-paper printing apparatus according to the first embodiment of the present invention.
Figure 6B:
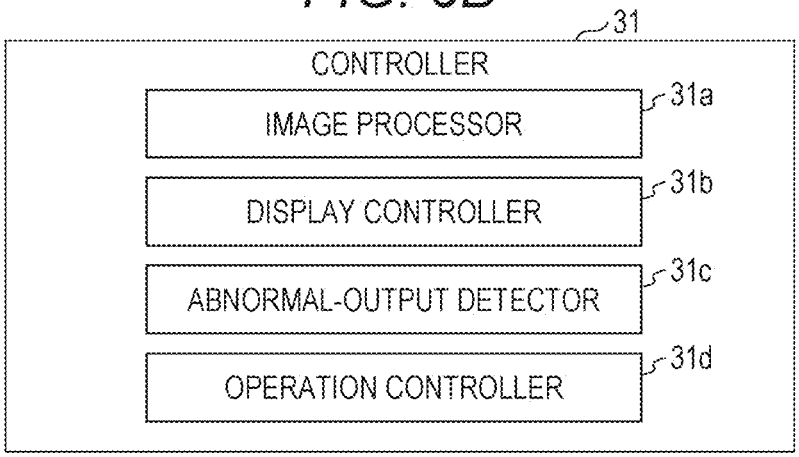
Figure 7:
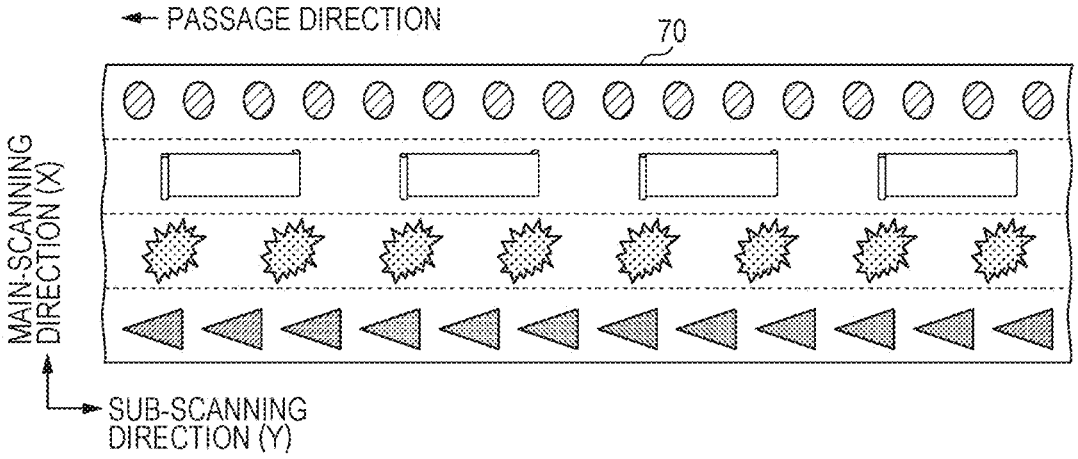
FIG. 7 is a schematic view for describing roll paper according to the first embodiment of the present invention.
Figure 8:
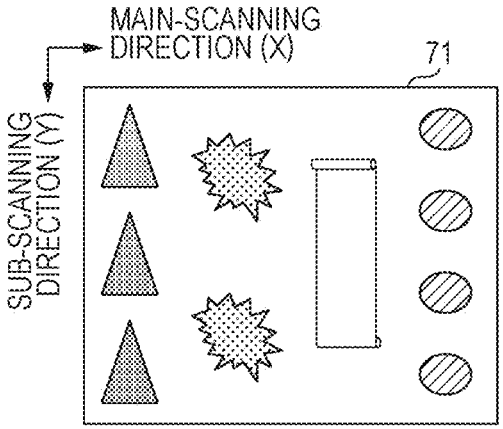
FIG. 8 is a schematic view for describing an original image according to the first embodiment of the present invention.
Figure 9:
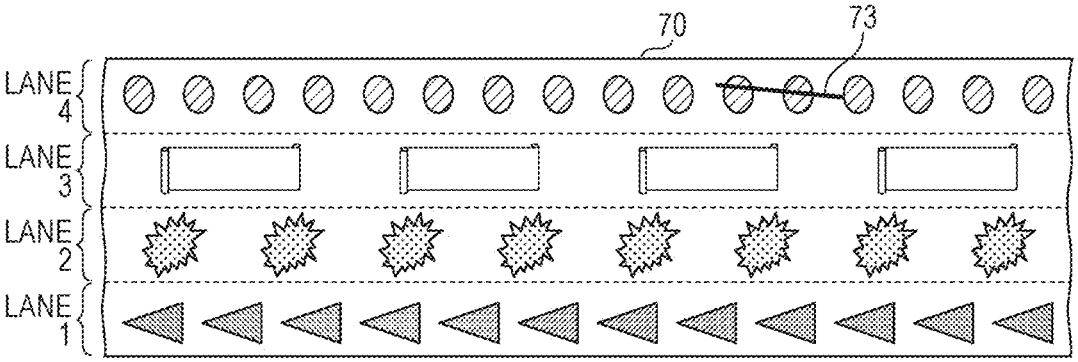
FIG. 9 is a schematic view for describing an abnormal output on the roll paper according to the first embodiment of the present invention.
Figure 10:
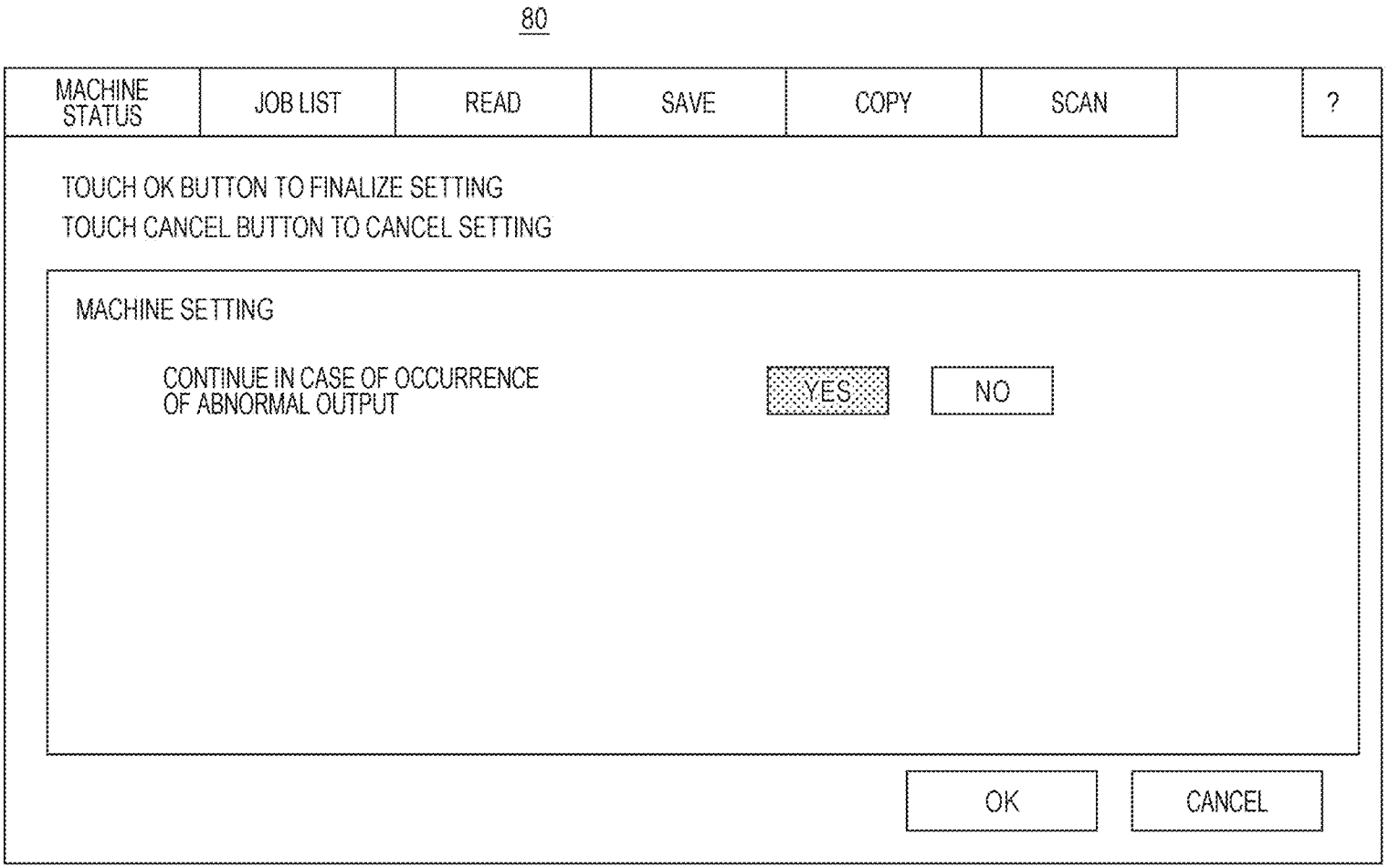
FIG. 10 is a schematic view of a setting screen to be displayed on the roll-paper printing apparatus according to the first embodiment of the present invention.
Figure 11:
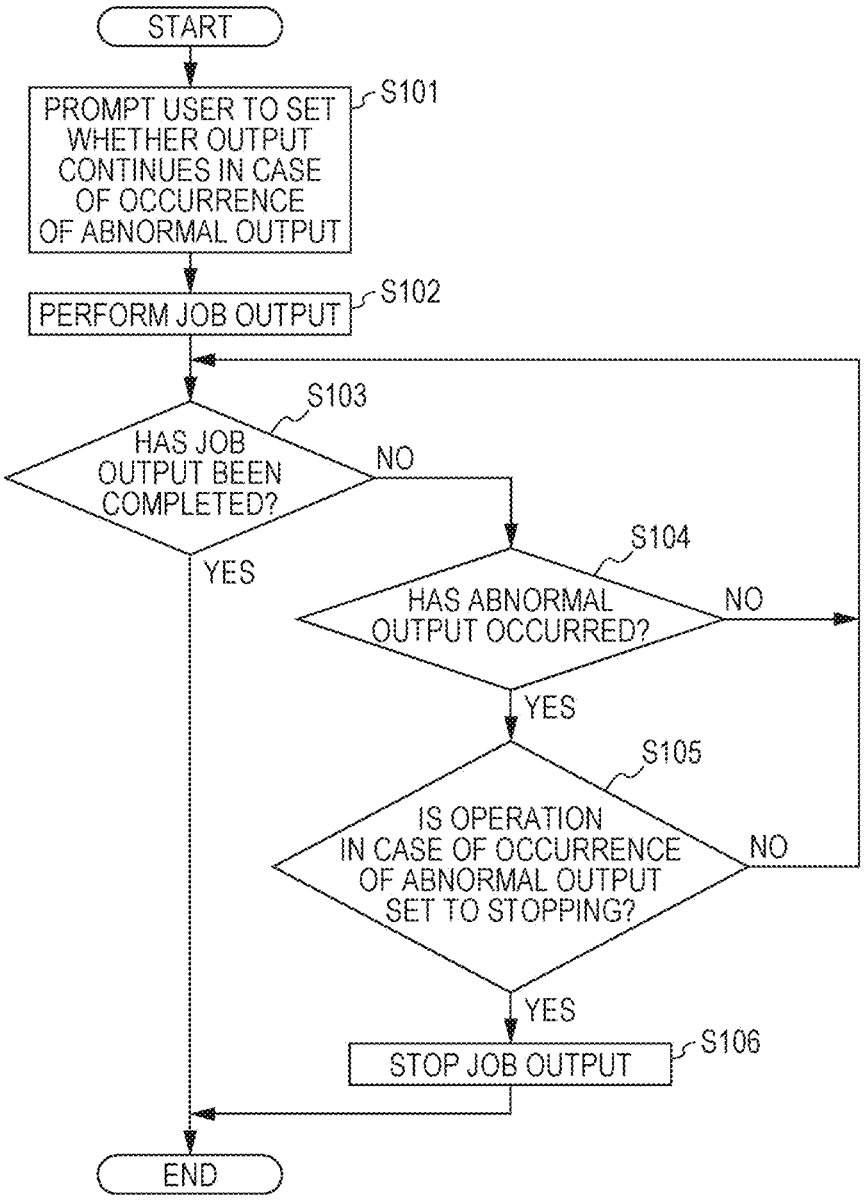
FIG. 11 is a flowchart of the operation of the roll-paper printing apparatus according to the first embodiment of the present invention.

In order to describe the one embodiment of the present invention in more detail, a roll-paper printing apparatus, a printing control program, and a printing control method according to a first embodiment of the present invention will be described with reference to FIG. 1 to FIG. 11. FIG. 1 and FIG. 2 are schematic views of configurations of a printing system according to the present embodiment. FIG. 3A and FIG. 3B are block diagrams of the configuration of a client apparatus. FIG. 4 and FIG. 5 are schematic views of the configuration of the roll-paper printing apparatus according to the present embodiment. FIG. 6A and FIG. 6B are block diagrams of the configuration of the roll-paper printing apparatus. FIG. 7 is a schematic view of an exemplary configuration of roll paper. FIG. 8 is a schematic view of the configuration of an original image. FIG. 9 is a schematic view for describing an abnormal output on the roll paper. FIG. 10 illustrates an exemplary setting screen to be displayed on the roll-paper printing apparatus according to the present embodiment. FIG. 11 is a flowchart of the operation of the roll-paper printing apparatus according to the present embodiment.

As illustrated in FIG. 1, a printing system 10 according to the present embodiment includes, for example, a client apparatus 20 and a roll-paper printing apparatus 30. The client apparatus 20 and the roll-paper printing apparatus 30 are connected through a communication network 60, such as a local area network (LAN) or a wide area network (WAN), prescribed by a standard, such as Ethernet (registered trademark), Token Ring, or Fiber-Distributed Data Interface (FDDI). Note that, although the printing system 10 includes the client apparatus 20 and the roll-paper printing apparatus 30 in FIG. 1, as illustrated in FIG. 2, a printer controller (control device) 50 that controls the roll-paper printing apparatus 30, may be provided. Each apparatus will be described below, on the basis of the configuration of FIG. 1.

[Client Apparatus]

The client apparatus 20 including a computer, such as a personal computer, includes, as illustrated in FIG. 3A, for example, a controller 21, a storage 25, a network I/F 26, a display 27, and an operator 28.

The controller 21 includes a central processing unit (CPU) 22 and memories, such as a read only memory (ROM) 23 and a random access memory (RAM) 24. The CPU 22 expands a control program stored in the ROM 23 or the storage 25, into the RAM 24 and executes the control program to control the operation of the entire client apparatus 20. As illustrated in FIG. 3B, the controller 21 (CPU 22) executes, for example, an operating system (OS) 21*a*, an application 21*b*, and a printer driver 21*c*.

The OS 21*a* including, for example, Windows (registered trademark), macOS (registered trademark), Android (registered trademark), or iOS (registered trademark) enables the client apparatus 20 to operate, for example, the application 21*b* and the printer driver 21*c*.

The application 21*b*, for example, for creating an original, generates original data including an original image disposed in a region corresponding to each lane arrayed in the width direction of the roll paper. Then, the printer driver 21*c* is read for a printing instruction, and the original data created by the application 21*b* is transferred to the printer driver 21*c*.

The printer driver 21*c* including a printing instruction program, converts the original data created by the application 21*b*, into a printing job in a language interpretable by the roll-paper printing apparatus 30 (page description language (PDL) data or portable document format (PDF) data described in a page description language, such as Printer Job Language (PJL), PostScript (PS), or Printer Control Language (PCL)), to transmit the printing job to the roll-paper printing apparatus 30. Printing setting information (printing ticket) in which printing conditions set on a printing setting screen for the printer driver 21*c* are described, is added to the printing job.

The storage 25 including, for example, a hard disk drive (HDD) or a solid state drive (SSD), stores the program for the CPU 22 to control each unit, the original data created by the application 21*b*, and the printing job generated by the printer driver 21*c*.

The network I/F 26 including, for example, a network interface card (NIC) or a modem, connects the client apparatus 20 to the communication network 60 to enable transmission of the printing job to the roll-paper printing apparatus 30.

The display 27 including, for example, a liquid crystal display (LCD) or an organic electroluminescent (EL) display, displays, for example, an original creation screen for the application 21*b* or the printing setting screen for the printer driver 21*c*.

The operator 28 including, for example, a mouse or a keyboard enables an operation, such as creation of an original with the application 21*b* or setting for printing with the printer driver 21*c*.

[Roll-Paper Printing Apparatus]

The roll-paper printing apparatus 30 including, for example, a multi-functional peripheral (MFP), performs printing on the roll paper, on the basis of the printing job received from the client apparatus 20. According to the present embodiment, as illustrated in FIG. 4, the roll-paper printing apparatus 30 includes, for example, a paper feeder 38 that feeds the roll paper, a printer 39 that forms an image based on the printing job on the roll paper, an image scanner 40 that scans the image formed on the roll paper, a cutter 41 that cuts the roll paper in the passage direction of the roll paper into the plurality of lanes arrayed in the width direction of the roll paper, and a reeler 42 that reels the cut roll paper per lane. FIG. 5 is a schematic view for describing a cutting mechanism for the roll paper. The printer 39 prints the image on the roll paper (original paper) supplied from the paper feeder 38. The image scanner 40 scans the image, and then the cutter 41 cuts the roll paper in the passage direction of the roll paper into the plurality of lanes (here, four lanes) arrayed in the width direction of the roll paper. Then, the reeler 42 reels the cut roll paper per lane.

As illustrated in FIG. 6A, the roll-paper printing apparatus 30 includes, for example, a controller 31, a storage 35, a network I/F 36, a display operator 37, the paper feeder 38, the printer 39, the image scanner 40, the cutter 41, and the reeler 42.

The controller 31 includes a CPU 32 and memories, such as a ROM 33 and a RAM 34. The CPU 32 expands a control program (including the printing control program according to the present embodiment) stored in the ROM 33 or the storage 35, into the RAM 34 and executes the control program to control the operation of the entire roll-paper printing apparatus 30. As illustrated in FIG. 6B, the controller 31 functions, for example, as an image processor 31*a*, a display controller 31*b*, an abnormal-output detector 31*c*, and an operation controller 31*d*.

The image processor 31*a* analyzes the printing job and rasterizes each page in the original included in the printing job to generate a printing image. As necessary, the image processor 31*a* performs image processing (e.g., color adjustment, density adjustment, or size adjustment) or screening to the printing image. Then, the image processor 31*a* transfers the generated printing image to the printer 39, and causes the printer 39 to perform printing processing.

The display controller 31*b* causes the display operator 37 to display a setting screen for setting of a condition of whether output of the job continues or stops in case of occurrence of an abnormal output. The display controller 31*b* notifies the operation controller 31*d* of the condition set on the setting screen.

The abnormal-output detector 31*c* acquires the scanned image scanned by the image scanner 40 and compares the image based on the printing job (the original image included in the printing job or the printing image generated by the image processor 31*a*) and the scanned image scanned by the image scanner 40, to detect an abnormal output. Examples of the abnormal output include a stain, such as a streak on an output image, a fault in density, such as undesired density, and a fault in color, such as undesired color.

The operation controller 31*d* determines whether the output of the job continues or stops, in accordance with the condition set on the setting screen. At that time, in a case where an abnormal output is detected on a lane, the output of the job continues.

The image processor 31*a*, the display controller 31*b*, the abnormal-output detector 31*c*, and the operation controller 31*d* may be provided as hardware. Alternatively, a printing control program that causes the controller 31 to function as the image processor 31*a*, the display controller 31*b*, the abnormal-output detector 31*c*, and the operation controller 31*d* (particularly, the abnormal-output detector 31*c* and the operation controller 31*d*), may be provided and the printing control program may be executed by the CPU 32.

The storage 35 including, for example, a HDD or a SSD, stores, for example, the program for the CPU 32 to control each unit, information regarding the processing function of the roll-paper printing apparatus 30, the printing job received from the client apparatus 20, data of the printing image generated by the image processor 31*a*, and data of the scanned image scanned by the image scanner 40.

The network I/F 36 including, for example, a NIC or a modem, connects the roll-paper printing apparatus 30 to the communication network 60, to enable reception of the printing job from the client apparatus 20.

The display operator 37 includes, for example, a touch panel having a display, provided with a pressure-sensitive operator (touch sensor), on which transparent electrodes are disposed in a grid pattern. The display operator 37 displays various screens regarding printing processing (particularly, a setting screen to be described later) to enable various operations regarding printing (particularly, a setting operation for a condition on the setting screen).

The paper feeder 38 supplies the roll paper to the printer 39.

The printer 39 forms the image on the roll paper supplied from the paper feeder 38 through a paper-feeding adjuster. For example, the printer 39 includes: an image former including an exposer that emits a laser beam to form a latent image, on the basis of image data, a photoconductor drum, a developer, a charger, a photoconductor cleaner, and a primary transfer roller, the image former being to form a toner image in each color for CMYK; an intermediate belt that functions as an intermediate transfer body that rotates due to a roller and conveys the toner image formed by the image former to the roll paper; a secondary transfer roller that transfers the toner image formed on the intermediate belt to the roll paper; and a fixer that fixes the toner image transferred on the roll paper.

The image scanner 40 including, for example, a scanning sensor provided above the conveyance path of the roll paper from the printer 39 to the cutter 41, scans the image formed on the roll paper and notifies the abnormal-output detector 31*c* of data of the scanned image.

The cutter 41 cuts the roll paper after the image scanning supplied from the image scanner 40 through a paper-discharge adjuster, in the passage direction of the roll paper into the plurality of lanes arrayed in the width direction of the roll paper.

The reeler 42 reels the roll paper cut by the cutter 41, per lane.

Note that FIG. 1 to FIG. 6A and FIG. 6B exemplarily illustrate the printing system 10 according to the present embodiment, and the configuration and the control of each apparatus can be appropriately changed as long as printing control according to the present embodiment can be achieved. For example, in FIG. 1 or FIG. 2, the printing system 10 includes the client apparatus 20, and the roll-paper printing apparatus 30 receives the printing job from the client apparatus 20. However, the roll-paper printing apparatus 30 may receive a printing job from a server or may acquire a printing job from a recording medium, such as a universal serial bus (USB) memory. FIG. 4 to FIG. 6A and FIG. 6B exemplify that the roll-paper printing apparatus 30 includes the cutter 41. However, the printing system 10 may include a cutting apparatus. The roll-paper printing apparatus 30 may reel the roll paper without cutting. The cutting apparatus may cut the roll paper in the passage direction of the roll paper into the plurality of lanes arrayed in the width direction of the roll paper. In that case, the roll-paper printing apparatus 30 may set the plurality of lanes and notify the cutting apparatus of information regarding the lanes. The cutting apparatus may set width for cutting of the roll paper, on the basis of the information regarding the lanes. Alternatively, after setting the width for cutting of the roll paper, the cutting apparatus may notify the roll-paper printing apparatus 30 of information regarding the width for cutting. The roll-paper printing apparatus 30 may set the plurality of lanes, on the basis of the information regarding the width for cutting.

The operation of the roll-paper printing apparatus 30 having the configuration of FIG. 4 to FIG. 6A and FIG. 6B, will be described in outline below.

In a case where the position at which an abnormal output is detected during printing on the roll paper is close to the printing start position (in a case where an abnormal output is detected at the initial stage of job processing), the roll-paper printing apparatus 30 may stop temporarily and re-printing may be performed with the unused portion of the roll paper. However, in a case where the position at which an abnormal output is detected is close to the printing end position, most of the portion is likely to be waste. Thus, according to the present embodiment, in a case where an abnormal output is detected on a lane during image printing on the plurality of lanes, the output continues in accordance with a condition set by a user. In this case, although the printed matter of the lane having the occurrence of the abnormal output is waste, printing on the other lanes having no trouble can be completed.

FIG. 7 illustrates an exemplary output image of the roll paper. The paper feeder 38 feeds the roll paper 70 to the printer 39 through the paper-feeding adjuster that adjusts passage speed. Then, the printer 39 forms the image on the roll paper. The image is scanned by the image scanner 40 and then is sent to the cutter 41 through the paper-discharge adjuster that adjusts passage speed. The cutter 41 cuts the roll paper 70 per lane (broken lines in the figure each indicate a cutting position), and the reeler 42 reels the cut roll paper 70 per lane.

FIG. 8 illustrates an exemplary original image of the printing job. Here, the original image 71 is created with a combination of four types of images. The original image 71 is created by, for example, the application 21*b* of the client apparatus 20. The original image 71 is transferred to the roll-paper printing apparatus 30 as printing setting information, such as the number of lanes and the width of each lane when transferred to the roll-paper printing apparatus 30. Alternatively, for example, the number of lanes and the width of each lane are set through the display operator 37 of the roll-paper printing apparatus 30. In roll-paper printing, repeatedly printing the original image 71 on the roll paper 70 allows acquisition of the output result of FIG. 7. Note that repeatedly disposition of the original image 71 results in a printing image.

FIG. 9 is a schematic view for describing an abnormal output (streak 73) on the roll paper 70. Detection of an abnormal output is performed in comparison between the image based on the printing job (the original image 71 or the printing image) and the scanned image scanned by the image scanner 40. The comparison between the image based on the printing job and the scanned image can be performed with a publicly known technique, such as pattern matching. In a case where a lane (here, lane 4) has occurrence of an abnormal output, the output continues in accordance with the previously set condition, so that printing on the lanes (here, lanes 1 to 3) having no trouble can be completed. The user can set in advance whether the output continues in case of occurrence of an abnormal output, for example, on a setting screen 80 as illustrated in FIG. 10.

The operation of the roll-paper printing apparatus 30 according to the present embodiment, will be described below. The CPU 32 expands the printing control program stored in the ROM 33 or the storage 35, into the RAM 34 and executes the printing control program to perform processing at each step illustrated in the flowchart of FIG. 11.

First, the controller 31 (display controller 31*b*) causes the display operator 37 to display the setting screen 80 as illustrated in FIG. 10, to prompt the user to set whether the output continues in case of occurrence of an abnormal output (S101).

Next, the controller 31 (image processor 31*a*) rasterizes the job to generate the printing image, and the printer 39 forms the printing image on the roll paper to perform output of the job (S102). Next, the controller 31 determines whether the output of the job has been completed (S103). In a case where the output of the job has not been completed (No at S103), the controller 31 (abnormal-output detector 31*c*) determines whether an abnormal output has occurred in comparison between the image based on the printing job and the scanned image scanned by the image scanner 40 from the roll paper (S104).

In a case where no abnormal output has occurred (the image based on the printing job and the scanned image are in agreement) (No at S104), the controller 31 goes back to S103 to continue the output of the job. In a case where an abnormal output has occurred (the image based on the printing job and the scanned image are in disagreement) (Yes at S104), the controller 31 (operation controller 31*d*) determines whether the operation in case of occurrence of an abnormal output is set to stopping on the setting screen 80 ("Continue in case of occurrence of abnormality" is set to "No") (S105).

In a case where the operation in case of occurrence of an abnormal output is not set to stopping ("Continue in case of occurrence of abnormality" is set to "Yes") (No at S105), the controller 31 (operation controller 31*d*) goes back to S103 to continue the output of the job. In a case where the operation in case of occurrence of an abnormal output is set to stopping ("Continue in case of occurrence of abnormality" is set to "No") (Yes at S105), the controller 31 (operation controller 31*d*) stops the output of the job (S106).

In this manner, the user is prompted to set whether the output continues in case of occurrence of an abnormal output. In comparison between the image based on the printing job and the scanned image, determination of whether an abnormal output has occurred is performed. Even in a case where a lane has occurrence of an abnormal output, the output of the job continues in a case where the output is set so as to continue, resulting in completion of printing on the other lanes. Thus, a waste of resources can be inhibited.

Second Embodiment

Figure 12:
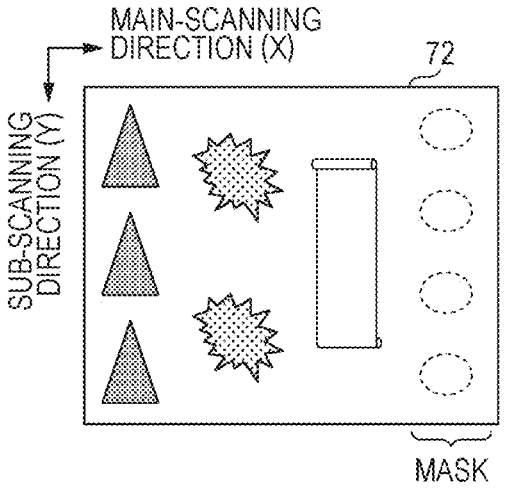
FIG. 12 is a schematic view for describing a print image according to a second embodiment of the present invention.
Figure 13:
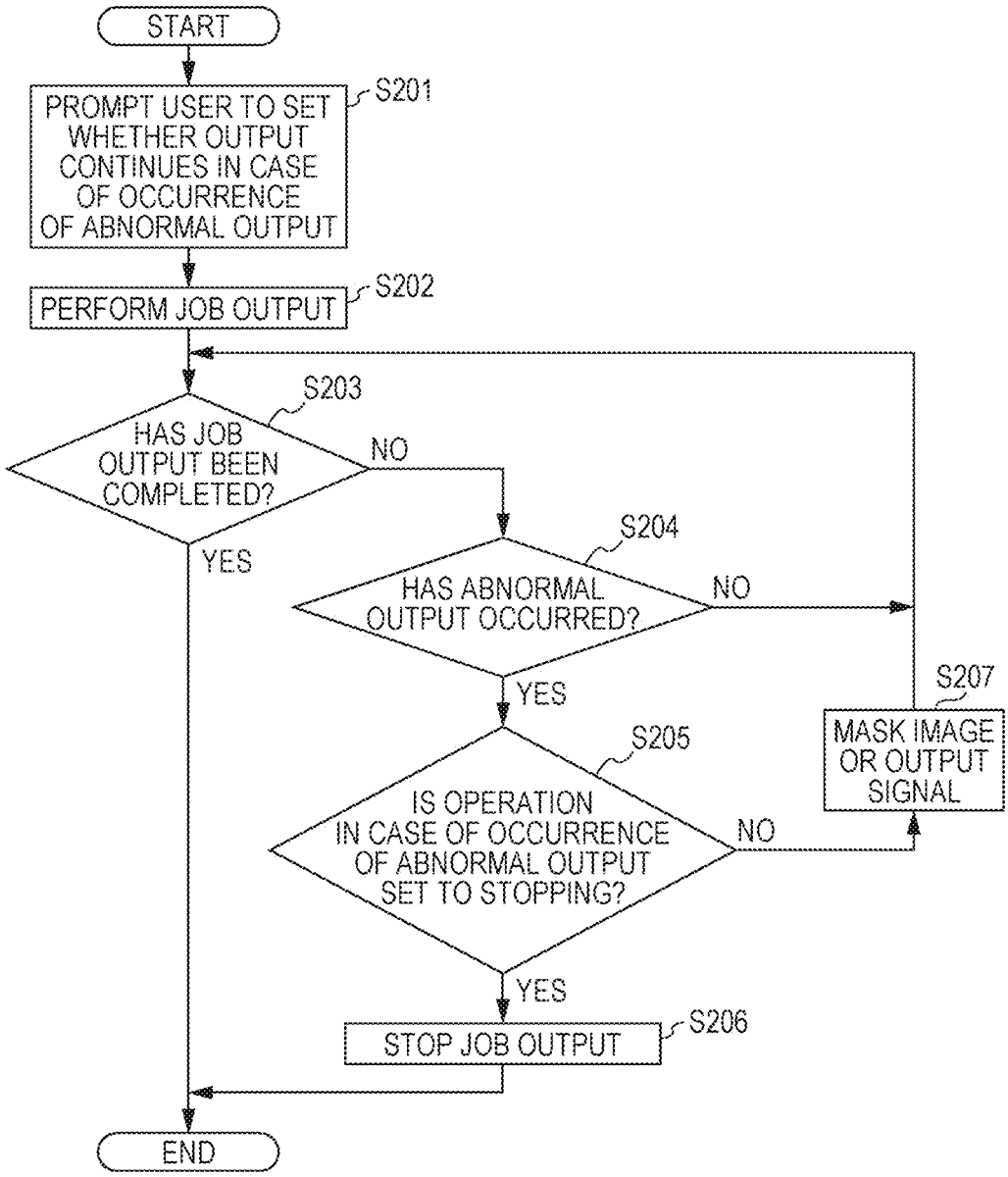
FIG. 13 is a flowchart of the operation of a roll-paper printing apparatus according to the second embodiment of the present invention.

Next, a roll-paper printing apparatus, a printing control program, and a printing control method according to a second embodiment of the present invention, will be described with reference to FIG. 12 and FIG. 13. FIG. 12 illustrates an exemplary printing image according to the present embodiment. FIG. 13 is a flowchart of the operation of the roll-paper printing apparatus according to the present embodiment.

According to the first embodiment, in a case where an abnormal output is detected and the output is set so as to continue, unusable output continues for a lane from which the abnormal output is detected, so that toner or the like is wastefully consumed. Thus, according to the present embodiment, in a case where an abnormal output is detected, control is performed so as not to allow output of an image for a lane from which the abnormal output is detected.

In that case, the configuration of the roll-paper printing apparatus 30 is similar to that in FIG. 4 to FIG. 6A and FIG. 6B according to the first embodiment. As necessary, an image processor 31*a* generates, in a case where an abnormal output is detected on a lane, a printing image on the basis of an original image to be formed on the other lanes except the lane from which the abnormal output is detected. For example, in a case where an abnormal output is detected on lane 4, as illustrated in FIG. 12, a printing image 72 is generated without the original image corresponding to lane 4 of FIG. 9 (elliptical images indicated with broken lines in the figure). As necessary, an operation controller 31*d* controls, in a case where an abnormal output is detected on a lane, a printer 39 such that the printing image of the lane from which the abnormal output is detected is not formed. For example, the exposure range of an exposer is limited such that a latent image corresponding to the printing image of the lane from which the abnormal output is detected is not formed. Note that, according to the present embodiment, a printing system 10 may include a cutting apparatus. The roll-paper printing apparatus 30 may reel roll paper without cutting. The cutting apparatus may cut the roll paper in the passage direction of the roll paper into the plurality of lanes arrayed in the width direction of the roll paper.

The operation of the roll-paper printing apparatus 30 according to the present embodiment, will be described below. A CPU 32 expands the printing control program stored in a ROM 33 or a storage 35, into a RAM 34 and executes the printing control program to perform processing at each step illustrated in the flowchart of FIG. 13.

First, a controller 31 (display controller 31*b*) causes a display operator 37 to display a setting screen 80 as illustrated in FIG. 10, to prompt a user to set whether the output continues in case of occurrence of an abnormal output (S201).

Next, the controller 31 (image processor 31*a*) rasterizes a job to generate a printing image, and the printer 39 forms the printing image on the roll paper to perform output of the job (S202). Next, the controller 31 determines whether the output of the job has been completed (S203). In a case where the output of the job has not been completed (No at S203), the controller 31 (abnormal-output detector 31*c*) determines whether an abnormal output has occurred in comparison between an image based on the printing job and a scanned image scanned by an image scanner 40 from the roll paper (S204).

In a case where no abnormal output has occurred (the image based on the printing job and the scanned image are in agreement) (No at S204), the controller 31 goes back to S203 to continue the output of the job. In a case where an abnormal output has occurred (the image based on the printing job and the scanned image are in disagreement) (Yes at S204), the controller 31 (operation controller 31*d*) determines whether the operation in case of occurrence of an abnormal output is set to stopping on the setting screen 80 ("Continue in case of occurrence of abnormality" is set to "No") (S205).

In a case where the operation in case of occurrence of an abnormal output is not set to stopping ("Continue in case of occurrence of abnormality" is set to "Yes") (No at S205), the controller 31 (image processor 31*a*) masks the image for a lane having the occurrence of the abnormal output, to generate the printing image 72 including only the images for the lanes having no occurrence of the abnormal output, or the controller 31 (operation controller 31*d*) masks an output signal of the lane having the occurrence of the abnormal output, to limit the exposure range of the exposer (S207). After that, the controller 31 (operation controller 31*d*) goes back to S203 to continue the output of the job. Meanwhile, in a case where the operation in case of occurrence of an abnormal output is set to stopping ("Continue in case of occurrence of abnormality" is set to "No") (Yes at S205), the controller 31 (operation controller 31*d*) stops the output of the job (S206).

In this manner, even in a case where the output of the job continues in case of detection of an abnormal output, control is performed so as not to allow formation of the image for the lane from which the abnormal output is detected, so that a waste of resources, such as toner, can be inhibited.

Third Embodiment

Figure 14:
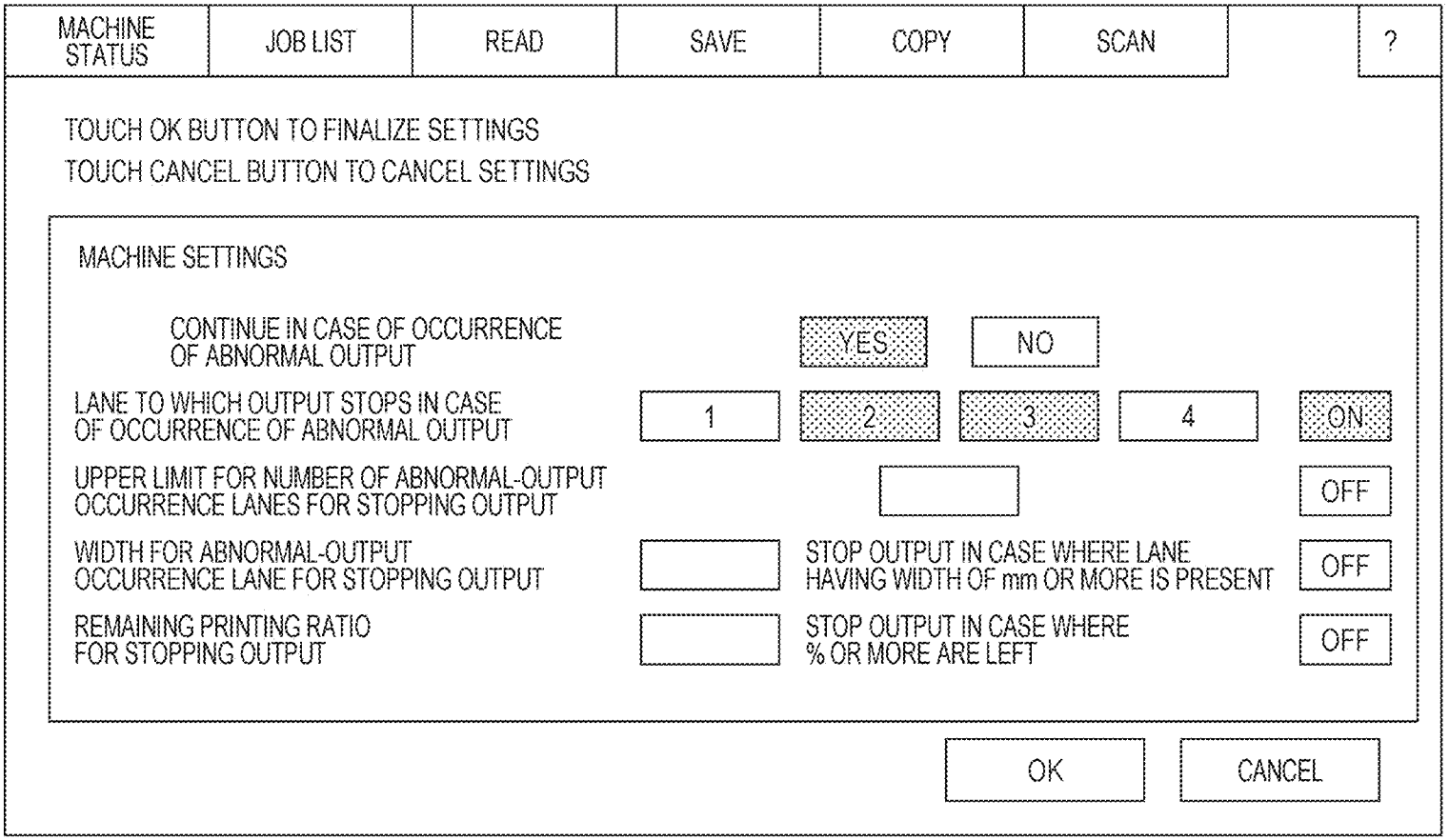
FIG. 14 is a schematic view of a setting screen to be displayed on a roll-paper printing apparatus according to a third embodiment of the present invention.
Figure 15:
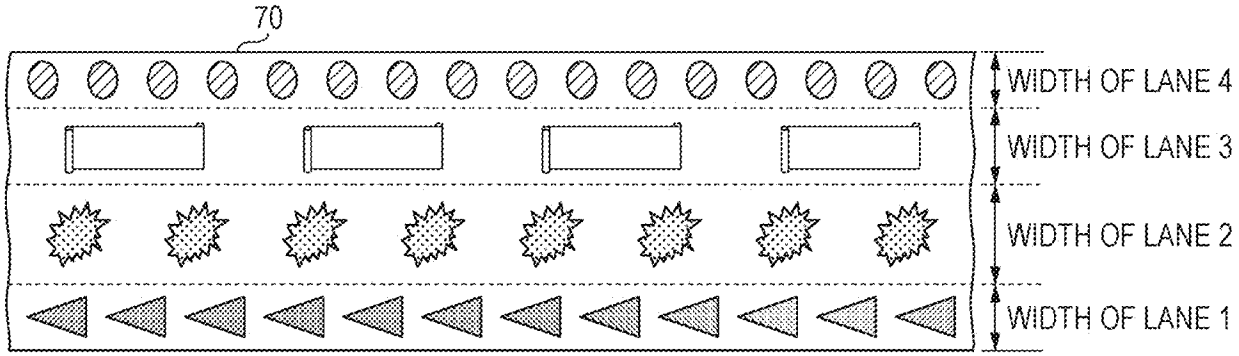
FIG. 15 is a schematic view for describing a lane width on roll paper according to the third embodiment of the present invention.
Figure 16:
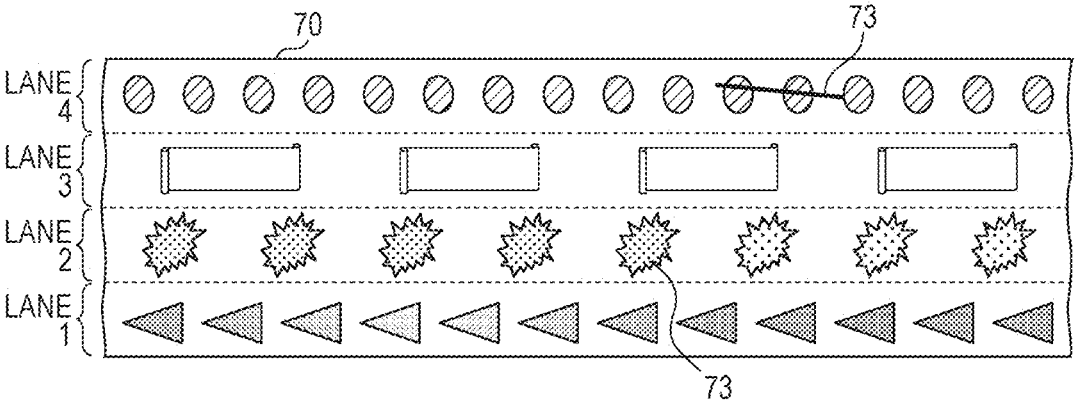
FIG. 16 is a schematic view for describing an abnormal output on the roll paper according to the third embodiment of the present invention.
Figure 17:
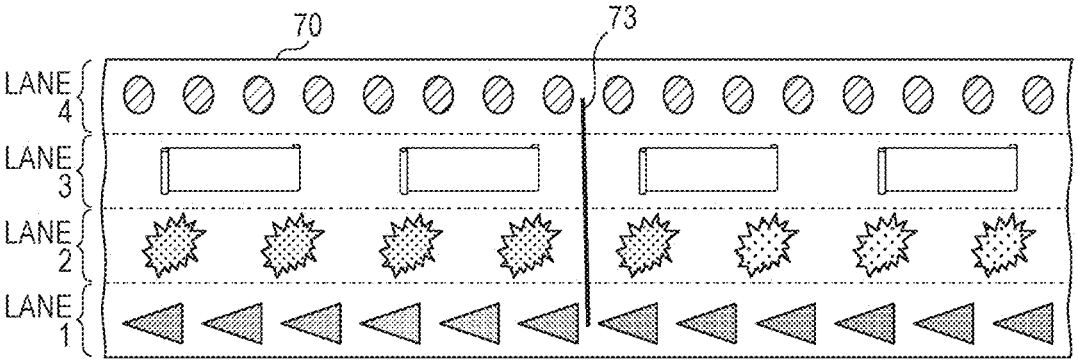
FIG. 17 is a schematic view for describing an abnormal output on the roll paper according to the third embodiment of the present invention.
Figure 18:
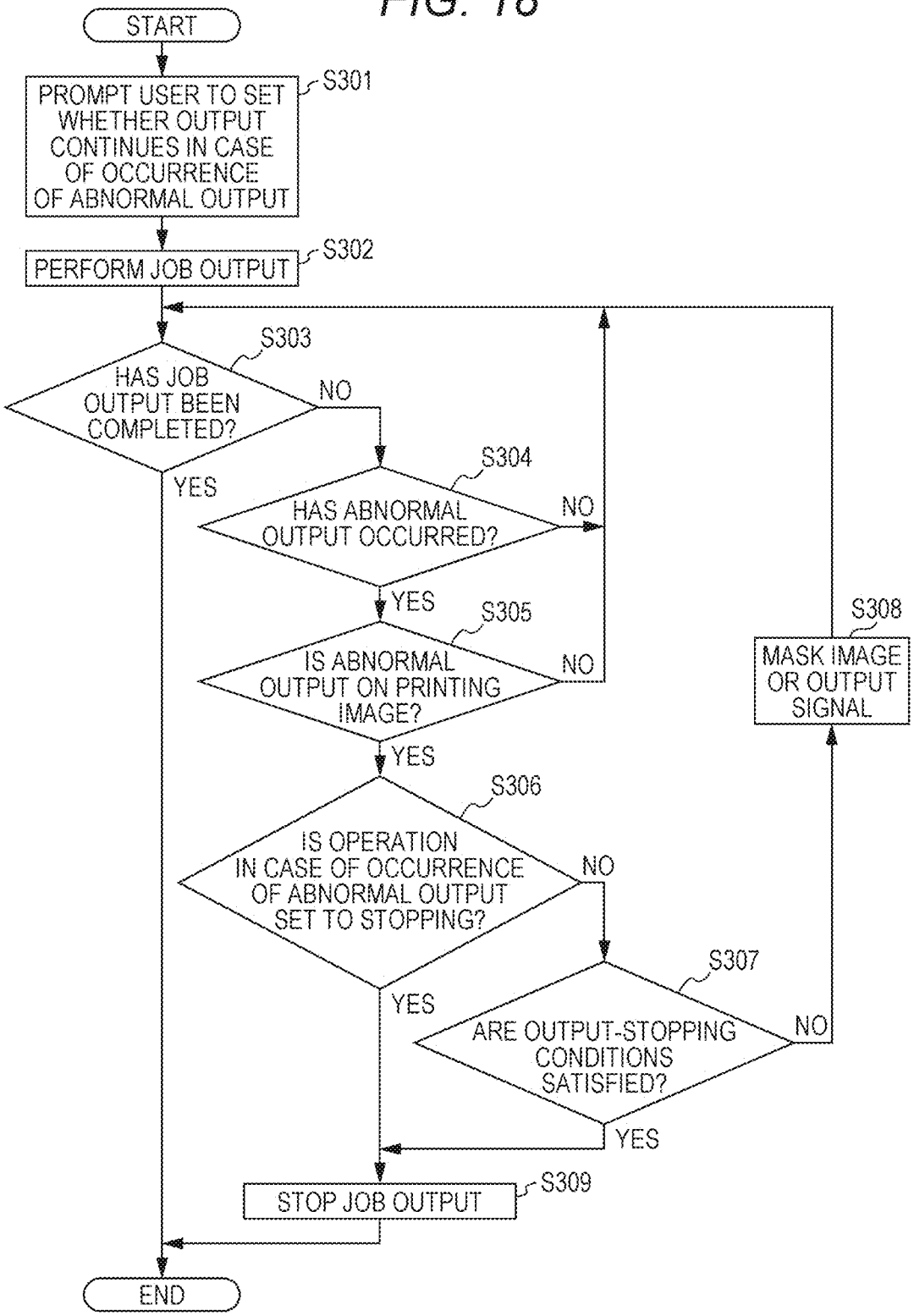
FIG. 18 is a flowchart of the operation of the roll-paper printing apparatus according to the third embodiment of the present invention.

Next, a roll-paper printing apparatus, a printing control program, and a printing control method according to a third embodiment of the present invention, will be described with reference to FIG. 14 to FIG. 19A to FIG. 19D. FIG. 14 illustrates an exemplary setting screen to be displayed on the roll-paper printing apparatus according to the present embodiment. FIG. 15 is a schematic view for describing the width of each lane of roll paper according to the present embodiment. FIG. 16 and FIG. 17 are schematic views each for describing an abnormal output on the roll paper according to the present embodiment. FIG. 18 and FIG. 19A to FIG. 19D are flowcharts of the operation of the roll-paper printing apparatus according to the present embodiment.

According to the first and second embodiments, the user is prompted to set whether the output of the job continues in case of occurrence of an abnormal output, on the setting screen. However, for example, in a case where an important lane has occurrence of an abnormal output, in a case where a number of lanes have occurrence of an abnormal output, in a case where a wide lane has occurrence of an abnormal output, or in a case where the remaining printing ratio is large, in some cases, stopping is preferable to continuation for the output of the job. Thus, the present embodiment enables advanced setting of conditions for stopping the output in case of occurrence of an abnormal output.

In that case, the configuration of the roll-paper printing apparatus 30 is similar to that in FIG. 4 to FIG. 6A and FIG. 6B according to the first embodiment. A display controller 31*b* causes a display operator 37 to display a setting screen 81 as illustrated in FIG. 14, so that a user can set details for the operation in case of occurrence of an abnormal output. Specifically, in a case where "Continue in case of occurrence of an abnormal output" is set to "Yes", an abnormal-output occurrence lane is settable for stopping the output. Designation of a lane is allowable, for example, the output stops in a case where lane 2 or lane 3 has occurrence of an abnormal output. An upper limit is settable for the number of abnormal-output occurrence lanes for stopping the output. Designation of the number of lanes is allowable, for example, the output stops in a case where two lanes have occurrence of an abnormal output in four lanes. A width is settable for an abnormal-output occurrence lane for stopping the output. Designation of a width of lane is allowable, for example, the output stops in a case where a lane having a certain width or more has occurrence of an abnormal output in a case where each lane is different in width. A remaining printing ratio (%) is settable for stopping the output. Designation of a threshold value is allowable, for example, the output stops in a case where the remaining printing portion is at a certain percentage or more of the entire job in case of occurrence of abnormality. An operation controller 31*d* determines whether the output of the job continues or stops, in accordance with the conditions set on the setting screen 81.

An ON/OFF button may enable switching of each detail setting between effectiveness and ineffectiveness. The ON/OFF button serving as a toggle can get effective due to depression, resulting in a display of ON. The ON/OFF button can get ineffective due to re-depression, resulting in a display of OFF.

In a case where an identical image is printed on each of a plurality of lanes, the controller 31 (operation controller 31*d*) may cause printing of the remaining output amount of a lane having occurrence of an abnormal output, on a lane on which necessary output is completed (namely, may instruct a printer 39 to print the remaining printing amount of a lane having occurrence of an abnormal output, on anther lane). In a case where different images are printed on the plurality of lanes, the controller 31 (operation controller 31*d*) may make a blank for a certain period or insert a color band such that image replacement is recognizable, and then may cause printing of the remaining output of a lane having occurrence of an abnormal output, on a lane on which necessary output is completed.

FIG. 15 illustrates an exemplary output image on the roll paper in which each lane is different in width. The width of each lane may be set when a client apparatus 20 creates the printing job. In a case where the roll-paper printing apparatus 30 performs image editing, the width may be acquired from image data.

FIG. 16 illustrates an exemplary output image on the roll paper in a case where a plurality of lanes each has occurrence of abnormality. Lane 4 has occurrence of a streak 73, and lane 2 has occurrence of a reduction in density. In this case, the operation is controlled in accordance with the settings on the setting screen 81. For example, in a case where lane 2 or lane 4 is set as a lane for stopping the output of the job, the output stops. In a case where the upper limit of the number of lanes for stopping the output of the job is set to two, the output stops. In a case where a width is set for a lane for stopping the output of the job and the width of lane 2 or lane 4 is the set width or more, the output stops. In a case where a remaining printing ratio is set for stopping the output of the job and the remaining printing ratio of any of the lanes is the set value or more, the output stops.

FIG. 17 illustrates an exemplary output image on the roll paper in a case where a streak 73 has occurred across a plurality of lanes. Typically, in a case where a margin of a cut sheet has occurrence of an abnormal output, such as a streak 73, the sheet results in waste paper. For roll paper, the portion except a printed portion is stripped. Thus, even when an abnormal output is detected in a region out of a printing image, the roll paper has no problem as an output product. Thus, the controller 31 (operation controller 31*d*) may determine whether the occurrence position of an abnormal output is on an image based on the printing job (printing image) or on the background (portion having a pixel value of "0"), and may continue the output in a case where the occurrence position is on the background.

Note that, according to the present embodiment, a printing system 10 may include a cutting apparatus. The roll-paper printing apparatus 30 may reel the roll paper without cutting. The cutting apparatus may cut the roll paper in the passage direction of the roll paper into the plurality of lanes arrayed in the width direction of the roll paper.

The operation of the roll-paper printing apparatus 30 according to the present embodiment, will be described below. A CPU 32 expands the printing control program stored in a ROM 33 or a storage 35, into a RAM 34 and executes the printing control program to perform processing at each step illustrated in the flowcharts of FIG. 18 and FIG. 19A to FIG. 19D.

First, the controller 31 (display controller 31*b*) causes the display operator 37 to display the setting screen 81 as illustrated in FIG. 14, to prompt the user to set output-stopping conditions in case of occurrence of an abnormal output as to whether the output continues in case of occurrence of an abnormal output (S301).

Next, the controller 31 (image processor 31*a*) rasterizes a job to generate a printing image, and the printer 39 forms the printing image on the roll paper to perform output of the job (S302). Next, the controller 31 determines whether the output of the job has been completed (S303). In a case where the output of the job has not been completed (No at S303), the controller 31 (abnormal-output detector 31*c*) determines whether an abnormal output has occurred in comparison between an image based on the printing job and a scanned image scanned by an image scanner 40 from the roll paper (S304).

In a case where no abnormal output has occurred (the image based on the printing job and the scanned image are in agreement) (No at S304), the controller 31 goes back to S303 to continue the output of the job. In a case where an abnormal output has occurred (the image based on the printing job and the scanned image are in disagreement) (Yes at S304), the controller 31 (abnormal-output detector 31*c*) determines whether the occurrence position of the abnormal output is on the printing image (S305). In a case where the occurrence position of the abnormal output is not on the printing image (No at S305), the controller 31 goes back to S303 to continue the output of the job. In a case where the occurrence position of the abnormal output is on the printing image (Yes at S305), the controller 31 (operation controller 31*d*) determines whether the operation in case of occurrence of an abnormal output is set to stopping on the setting screen 81 ("Continue in case of occurrence of abnormality" is set to "No") (S306).

In a case where the operation in case of occurrence of an abnormal output is not set to stopping ("Continue in case of occurrence of abnormality" is set to "Yes") (No at S306), the controller 31 (operation controller 31*d*) determines whether the output-stopping conditions set on the setting screen 81 are satisfied (S307). In a case where the output-stopping conditions are not satisfied (No at S307), as necessary, the controller 31 (image processor 31*a*) masks the image for a lane having the occurrence of the abnormal output, to generate a printing image 72 including only the images for the lanes having no occurrence of the abnormal output, or the controller 31 (operation controller 31*d*) masks an output signal of the lane having the occurrence of the abnormal output, to limit the exposure range of the exposer (S308). After that, the controller 31 (operation controller 31*d*) goes back to S303 to continue the output of the job. Meanwhile, in a case where the operation in case of occurrence of an abnormal output is set to stopping ("Continue in case of occurrence of abnormality" is set to "No") (Yes at S306) or in a case where the output-stopping conditions set on the setting screen 81 are satisfied (Yes at S307), the controller 31 (operation controller 31*d*) stops the output of the job (S309).

Figure 19A:
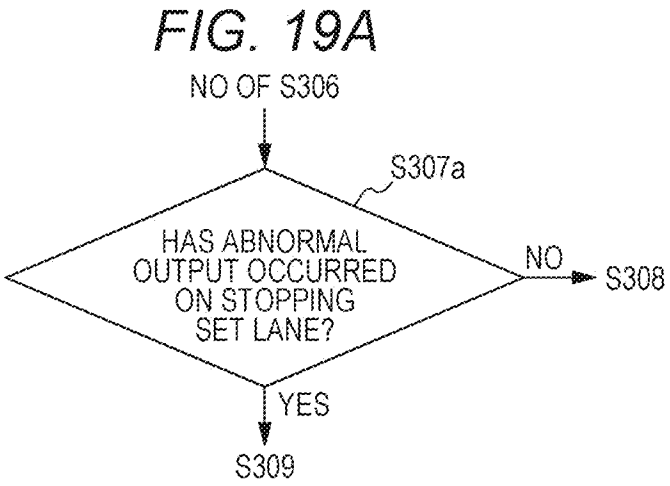
FIG. 19A to FIG. 19D are flowcharts of the operation of the roll-paper printing apparatus according to the third embodiment of the present invention (details of S307).
Figure 19B:
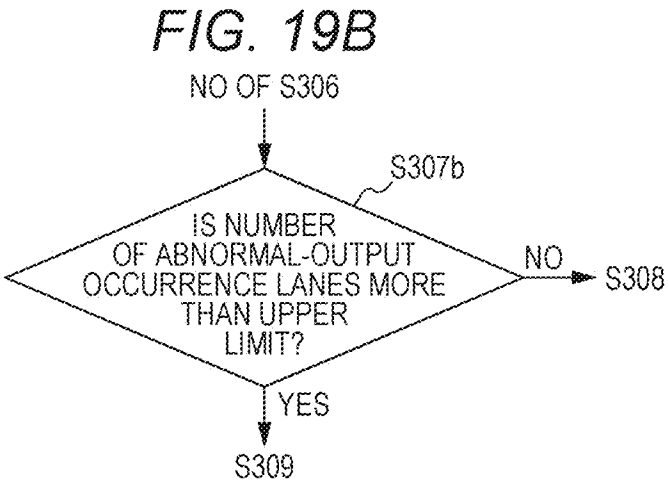
Figure 19C:
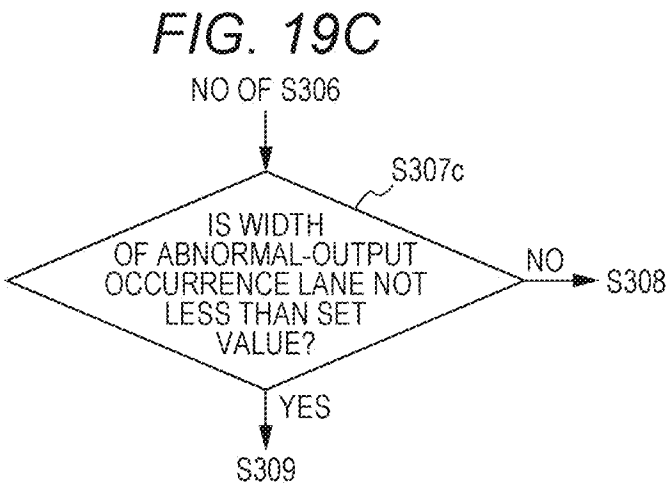
Figure 19D:
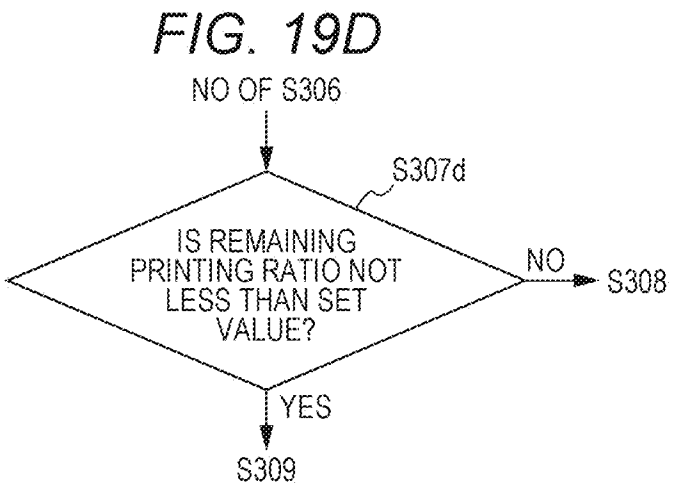

FIG. 19A to FIG. 19D illustrate specific examples of whether the output-stopping conditions are satisfied, at S307. For example, as illustrated in FIG. 19A, the controller 31 (operation controller 31*d*) determines whether the abnormal output has occurred on a stopping set lane (S307*a*). In a case where no abnormal output has occurred on the stopping set lane, the controller 31 (operation controller 31*d*) masks the image or the output signal (S308) and continues the output of the job. In a case where the abnormal output has occurred on the stopping set lane, the controller 31 (operation controller 31*d*) stops the output (S309). As illustrated in FIG. 19B, the controller 31 (operation controller 31*d*) determines whether the number of abnormal-output occurrence lanes is more than the upper limit (S307*b*). In a case where the number of abnormal-output occurrence lanes is not more than the upper limit, the controller 31 (operation controller 31*d*) masks the image or the output signal (S308) and continues the output of the job. In a case where the number of abnormal-output occurrence lanes is more than the upper limit, the controller 31 (operation controller 31*d*) stops the output (S309). As illustrated in FIG. 19C, the controller 31 (operation controller 31*d*) determines whether the width of an abnormal-output occurrence lane is the set value or more (S307*c*). In a case where the width of the abnormal-output occurrence lane is less than the set value, the controller 31 (operation controller 31*d*) masks the image or the output signal (S308) and continues the output of the job. In a case where the width of the abnormal-output occurrence lane is the set value or more, the controller 31 (operation controller 31*d*) stops the output (S309). As illustrated in FIG. 19D, the controller 31 (operation controller 31*d*) determines whether the remaining printing ratio is the set value or more (S307*d*). In a case where the remaining printing ratio is less than the set value, the controller 31 (operation controller 31*d*) masks the image or the output signal (S308) and continues the output of the job. In a case where the remaining printing ratio is the set value or more, the controller 31 (operation controller 31*d*) stops the output (S309).

Note that, in FIG. 19A to FIG. 19D, the controller 31 (operation controller 31*d*) individually determines whether the abnormal output has occurred on a stopping set lane, whether the number of abnormal-output occurrence lanes is more than the upper limit, whether the width of an abnormal-output occurrence lane is the set value or more, and whether the remaining printing ratio is the set value or more. However, a determination can be made with any combination of these.

In this manner, the output-stopping conditions in case of occurrence of an abnormal output can be set in detail. Thus, the output can stop properly, for example, in a case where an important lane has occurrence of an abnormal output, in a case where a number of lanes have occurrence of an abnormal output, in a case where a wide lane has occurrence of an abnormal output, or in a case where the remaining printing ratio is large.

Note that the present invention is not limited to the embodiments, and appropriate alterations may be made in configuration or control without departing from the spirit of the present invention.

For example, each embodiment has exemplified that the roll paper is divided into four lanes. However, the printing control method according to each embodiment of the present invention can be similarly applied to division into at least two lanes.

The present invention is usable for a roll-paper printing apparatus that performs printing on roll paper, a printing control program of controlling the printing on the roll paper, a recording medium storing the printing control program, and a printing control method in the roll-paper printing apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. A roll-paper printing apparatus including a paper feeder that feeds roll paper, a printer that forms an image based on a job on the roll paper, an image scanner that scans the image formed on the roll paper, and a reeler that reels the roll paper, the roll-paper printing apparatus comprising a hardware processor that acquires the image scanned by the image scanner from the roll paper and detects an abnormal output in comparison between the image based on the job and the scanned image, and determines whether output of the job continues or stops, in accordance with a previously set condition, wherein, in a case where the roll paper is cut in a passage direction of the roll paper into a plurality of lanes arrayed in a width direction of the roll paper, the hardware processor continues, in a case where the abnormal output is detected on a lane, the output of the job, and the hardware processor continues the output of the job in at least one of a case where a lane having occurrence of the abnormal output is not a previously set lane, a case where a number of lanes having occurrence of the abnormal output is not more than a previously set number, a case where a width of a lane having occurrence of the abnormal output is less than a previously set value, and a case where a remaining printing ratio of the job when the abnormal output is detected is less than a previously set value.

2. The roll-paper printing apparatus according to claim 1, wherein the hardware processor analyzes the job and generates the image to be formed on the roll paper, and generates, in the case where the abnormal output is detected on the lane, a predetermined image to be formed on another lane except the lane from which the abnormal output is detected, and the printer forms the predetermined image on the roll paper.

3. The roll-paper printing apparatus according to claim 1, wherein the printer includes an exposer that emits a laser beam to form a latent image, and the hardware processor limits, in the case where the abnormal output is detected on the lane, an exposure range of the exposer such that a latent image corresponding to an image for the lane from which the abnormal output is detected is not formed.

4. The roll-paper printing apparatus according to claim 1, wherein the hardware processor causes a display to display a setting screen for setting of at least one of a lane, the number of lanes, a width of a lane, and a remaining printing ratio for the determination of whether the output of the job continues or stops.

5. The roll-paper printing apparatus according to claim 1, wherein the hardware processor continues, in a case where an occurrence position of the abnormal output is not on the image based on the job, the output of the job.

6. The roll-paper printing apparatus according to claim 1, wherein the hardware processor instructs, in a case where an identical image is printed on each of the plurality of lanes, the printer to print a remaining printing amount of a lane having occurrence of the abnormal output on another lane.

7. The roll-paper printing apparatus according to claim 1, wherein a post-stage of the image scanner is provided with a cutter that cuts the roll paper, and the reeler reels the cut roll paper for each of the plurality of lanes.

8. A non-transitory recording medium storing a computer readable printing control program that operates in a roll-paper printing apparatus including a paper feeder that feeds roll paper, a printer that forms an image based on a job on the roll paper, an image scanner that scans the image formed on the roll paper, and a reeler that reels the roll paper, the printing control program causing the roll-paper printing apparatus to perform:

acquiring the image scanned by the image scanner from the roll paper and detecting an abnormal output in comparison between the image based on the job and the scanned image; and determining whether output of the job continues or stops, in accordance with a previously set condition, wherein, in a case where the roll paper is cut in a passage direction of the roll paper into a plurality of lanes arrayed in a width direction of the roll paper, the determining includes continuing, in a case where the abnormal output is detected on a lane, the output of the job, wherein the determining includes continuing the output of the job in at least one of a case where a lane having occurrence of the abnormal output is not a previously set lane, a case where a number of lanes having occurrence of the abnormal output is not more than a previously set number, a case where a width of a lane having occurrence of the abnormal output is less than a previously set value, and a case where a remaining printing ratio of the job when the abnormal output is detected is less than a previously set value.

9. The non-transitory recording medium storing the computer readable printing control program according to claim 8, the printing control program causing the roll-paper printing apparatus to further perform analyzing the job and generating the image to be formed on the roll paper, wherein the analyzing and generating include generating, in the case where the abnormal output is detected on the lane, a predetermined image to be formed on another lane except the lane from which the abnormal output is detected, and transferring the predetermined image to the printer.

10. The non-transitory recording medium storing the computer readable printing control program according to claim 8, wherein the printer includes an exposer that emits a laser beam to form a latent image, and the determining includes limiting, in the case where the abnormal output is detected on the lane, an exposure range of the exposer such that a latent image corresponding to an image for the lane from which the abnormal output is detected is not formed.

11. The non-transitory recording medium storing the computer readable printing control program according to claim 8, the printing control program causing the roll-paper printing apparatus to further perform causing a display to display a setting screen for setting of at least one of a lane, the number of lanes, a width of a lane, and a remaining printing ratio for the determination of whether the output of the job continues or stops.

12. The non-transitory recording medium storing the computer readable printing control program according to claim 8, wherein the determining includes continuing, in a case where an occurrence position of the abnormal output is not on the image based on the job, the output of the job.

13. The non-transitory recording medium storing the computer readable printing control program according to claim 8, wherein the determining includes instructing, in a case where an identical image is printed on each of the plurality of lanes, the printer to print a remaining printing amount of a lane having occurrence of the abnormal output on another lane.

14. The non-transitory recording medium storing the computer readable printing control program according to claim 8, wherein, in a case where the roll paper is cut in a passage direction of the roll paper into a plurality of lanes arrayed in a width direction of the roll paper, the determining includes continuing, in a case where the abnormal output is detected on a lane, the output of the job.

15. A roll-paper printing apparatus including a paper feeder that feeds roll paper, a printer that forms an image based on a job on the roll paper, an image scanner that scans the image formed on the roll paper, and a reeler that reels the roll paper, the roll-paper printing apparatus comprising a hardware processor that acquires the image scanned by the image scanner from the roll paper and detects an abnormal output in comparison between the image based on the job and the scanned image, and determines whether output of the job continues or stops, in accordance with a previously set condition, wherein, in a case where the roll paper is cut in a passage direction of the roll paper into a plurality of lanes arrayed in a width direction of the roll paper, the hardware processor continues, in a case where the abnormal output is detected on a lane, the output of the job, and an image is not formed on a lane on which abnormality is detected and an image is formed on another lane except the lane.

* * * * *